United States Patent [19]

Murray

[11] Patent Number: 4,967,841

[45] Date of Patent: Nov. 6, 1990

[54] HORIZONTAL WELL CIRCULATION TOOL

[75] Inventor: Douglas J. Murray, Tulsa, Okla.

[73] Assignee: Baker Hughes Incorporated, Houston, Tex.

[21] Appl. No.: 308,888

[22] Filed: Feb. 9, 1989

[51] Int. Cl.[5] ..... E21B 21/00; E21B 37/00; B08B 9/02

[52] U.S. Cl. ..... 166/312; 166/222; 166/223; 166/318; 15/104.05; 15/104.061; 15/104.09; 134/22.12; 134/24

[58] Field of Search ..... 166/311, 312, 170, 173, 166/222, 223, 373, 374, 381, 386, 318, 332; 175/107; 15/104.061, 104.05, 104.09, 104.12; 134/22.12, 24, 32, 33, 167 R, 172, 191, 198

[56] References Cited

U.S. PATENT DOCUMENTS

| | | | |
|---|---|---|---|
| 2,336,293 | 12/1943 | Pletcher | 15/104.12 |
| 2,735,794 | 2/1956 | Pletcher | 15/104.12 |
| 2,785,875 | 3/1957 | Hayes | 166/223 |
| 3,066,735 | 12/1962 | Zingg | 166/222 |
| 3,542,130 | 11/1970 | Stout | 166/318 |
| 3,547,191 | 12/1970 | Malott | 166/223 |
| 3,593,786 | 7/1971 | Lewis | 166/318 |
| 3,844,362 | 10/1974 | Elbert et al. | 166/223 |
| 3,912,173 | 10/1975 | Robichaux | 166/222 |
| 4,031,971 | 6/1977 | Miller | 15/104.12 |
| 4,037,661 | 7/1977 | Ford | 166/223 |
| 4,113,236 | 9/1978 | Neinast | 15/104.05 |
| 4,442,899 | 4/1984 | Zublin | 166/222 |
| 4,518,041 | 5/1985 | Zublin | 166/222 |
| 4,645,006 | 2/1987 | Tinsley | 166/318 |
| 4,705,107 | 11/1987 | Council et al. | 15/104.12 |
| 4,744,420 | 5/1988 | Patterson et al. | 166/312 |
| 4,749,044 | 6/1988 | Skipper et al. | 166/312 |

*Primary Examiner*—Bruce M. Kisliuk

*Attorney, Agent, or Firm*—Hubbard, Thurman, Turner, Tucker

[57] ABSTRACT

Apparatus and method are provided for washing apparatuses in use of remedial tubing. A cylindrical housing has a fluid expansion chamber with fluid passageways communicating between the housing and the chamber. A turbulating sleeve freely rotates relative to the housing. Compression ports permit fluid to be transmitted through the housing, the passageways and into the chamber for injection through the ports to activate rotary motion of the sleeve for turbulizing washing action. A second housing is provided on the apparatus having normally closed wash ports which are angularly directed toward the remedial tubing and rearwardly relative to the apparatus. The wash ports are normally closed and may be opened, selectively, and when open, fluid flow through the apparatus is directed only through the rearwardly directed wash ports to drive particulate matter impacted exterior of the tubing and rearwardly of the apparatus from the apparatus.

7 Claims, 2 Drawing Sheets

HORIZONTAL WELL CIRCULATION TOOL

CROSS-REFERENCE TO RELATED APPLICATIONS

This application is related, in part, to application Ser. No. 07,309,825, filed on the same date as this application, entitled "HORIZONTAL WELL TURBULIZER AND METHOD", and assigned to the same assignee as the present invention.

BACKGROUND OF THE INVENTION

1. Field of the Invention

The invention is directed to a method and apparatus for washing particulate matter away from an apparatus within a horizontal section of a deviated subterranean well together with means for washing particulate matter away from remedial tubing as such tubing is thereafter retrieved to the top of the well. The washing apparatus and method used during the retrieval of the remedial tubing to the top of the well may be used independently of the apparatus for washing around the exterior of the apparatus when said apparatus is within the horizontal section of a deviated well.

2. Description of the Prior Art

In the past, those skilled in the art relating to remedial operations associated with the drilling, production and completion of subterranean oil and gas wells have relied on conventional "snubbing" or hydraulic workover units which utilize threaded or coupled remedial tubing normally inserted through production tubing for use in operations, such as perforating, acidizing and fracturing, corrosion control, pressure testing of tubular goods and vessels, cementing, clean out operations, sand bridge removal, storm valve recovery, insertion of kill strings, wireline tool fishing, and the like.

Continuous coiled remedial tubing and injectors for use therewith have contributed substantially to conventional remedial tubing operations. For example, coil tubing, being continuous, can be inserted into the well faster than threaded and coupled tubing which is furnished in relatively short sections that must be screwed together. In addition, it is easier, when required, to pass continuous tubing through stuffing boxes and blowout preventers because its external diameter is consistently the same size and not interrupted periodically by couplings. The coiled remedial tubing normally is made of steel and is commercially available in sizes from 0.75 inch o.d. through 1.315 inch o.d., but may have a smaller or larger diameter. Typical of such remedial coil tubing and injectors is that generally described in U.S. Pat. No. 3,182,877. The apparatus is commercially referred to as the "Bowen Continuous Spring Tubing Injector Unit" and basically comprises a hydraulically powered injector unit which feeds a continuous remedial tubing string from a coiled or "spooled" workstring contained on a powered and generally portable reel unit into the wellhead by means of two opposed, endless, rotating traction members. Such a reel unit is generally described in U.S. Pat. No. 3,614,019. The upper end of the string which remains on the reel is conventionally connected to the hollow shaft of the reel which permits a liquid or a gas to be pumped through the coiled remedial tubing string by means of a swivel connection. The injector and reel are normally mounted on a single transportable skid, a trailer, or, alternatively, may be componently arranged on skids to facilitate convenient offshore use.

To inject remedial coiled tubing, the injector is arranged on or above the wellhead. The reel unit, containing up to approximately 15,000 feet of continuous coiled metal remedial tubing, is located preferably about 15 to 20 feet from the wellhead. The remedial coiled tubing is brought from the reel in a smooth arc loop through the injector unit and into the well through pressure retention and control equipment.

For many years the desirability of utilizing a subterranean wellbore having a non-vertical or horizontal portion traversing a production formation has been known and appreciated in the prior art. Laterally directed bores are drilled radially, usually horizontally from the primary vertical wellbore, in order to increase contact with the production formation. Most production formations have a substantial horizontal portions and, when conventional vertical wellbores are employed to tap such production formations, a large number of vertical bores must be employed. With the drilling of a wellbore having a non-vertical or horizontal portion traversing the production formation, a much greater area of the production formation may be traversed by the wellbore and the total field of drilling costs may be substantially decreased. Additionally, after a particular horizontal wellbore has produced all of the economically available hydrocarbons, the same vertical wellbore may be redrilled to establish another horizontal portion extending in another direction and thus prolong the utility of the vertical portion of the well and increase the productivity of the well to include the total production formation.

By use of and reference to the phrase "wellbore" herein, it is intended to include both cased and uncased wells. When uncased wells are completed, the bore hole wall defines the maximum hole diameter at a given location. When cased wells are completed, the "wall" of the well will be the internal diameter of the casing conduit.

By use of the phrase "deviated well" and "deviated wellbore", it is meant to refer to wells and wellbores which comprise a vertical entry section communicating through a relatively short radius curvature portion with a non-vertical or horizontal portion communicating with the production formation. In most instances, the production formation extends for a substantial horizontal extent and the generally linear wellbore portion traverses a substantial horizontal extent of the production formation, at least up to a distance of 1000 to 2000 feet, or more. The radius portion of the wellbore has a curvature of at least 10° per 100 feet of length, and preferably a curvature lying in the range of 10° to 30° per 100 feet of length.

In such deviated well bores, particularly those having the longer lengths, fracturing fluids can be expected to be introduced into the linear, or horizontal, end portion of the well to frac the production zone to open up production fissures and pores therethrough. Such action will result in particulate matter flowing into the wellbore, particularly from top to bottom, through perforations within the casing, such that it will become difficult, if not impossible to laterally move devices through the production tubing which are required for certain completion operations in such linear or horizontal end portion of such wells. Because of the horizontal nature of such linear end portions of such wells, such material can be expected to gravitate, collect, and compact, particularly on the downward-most side and within the production tubing. It would then be desirable to first break up such compaction by providing a suspension of such particulate matter within the washing, or other, fluid, and thereafter circulate such suspended particulate matter to the top of the well, for removal.

As remedial tubing is introduced into the well through the production tubing, in such deviated horizontal wells during the completion operation, it is to be anticipated that particulate matter, such as sand, gravel packing materials, or the like, will become compacted exterior of the remedial tubing such that upon upward longitudinal manipulation of the remedial tubing subsequent to the remedial activity, it will be difficult, if not impossible, to remove the remedial tubing from within the production tubing. In addition to the washing portion of the apparatus described above, the present invention also provides means for injecting a wash fluid through the remedial tubing and directing such injected wash fluid upwardly and frontally toward the remedial tubing in a radial fashion to wash the impacted particulate matter around the remedial tubing away therefrom to permit such tubing to be retrieved, freely, to the top of the well without interference with the impacted particulate matter which has settled around the remedial tubing during the particular completion operation.

SUMMARY OF THE INVENTION

The invention provides a method and apparatus for washing particulate matter away from the exterior of remedial tubing introduceable through production tubing in an encased well, such as a deviated horizontal well. In a preferred form, the apparatus is secured onto one end of a continuous length of remedial tubing which is introduceable into the well and concentrically insertable through the production tubing previously positioned within the well with the well having a deviated configuration including an entry portion communicating with a curved portion extending downwardly in the well from the entry portion and a generally linear end portion traversable with a production formation. The apparatus comprises a first cylindrical housing and means at one end of the housing for carryable securement relative to the one end of the remedial tubing. A fluid expansion chamber is carried exterior of the housing and fluid passageways communicate between the interior of the first cylindrical housing and the expansion chamber. Turbulating sleeve means are carried exteriorly around the housing and immediate said expansion chamber and freely rotatable relative to said housing. A series of first compression ports are radially disposed through the sleeve means whereby fluid flow from the top of the well through the remedial tubing in excess of a pre-determinable pressure will be transmitted through the housing, the passageways and into the compression chamber and said fluid may be thereafter injected through the fluid compression ports to activate rotary motion of said sleeve and turbulize the fluid for washing action within the linear end portion of the well. A second cylindrical housing is provided between the first cylindrical housing and the remedial tubing and has thereon normally closed wash ports circumferentially extending radially therearound and angularly directed toward the remedial tubing. Means are provided for closing the wash ports and selectively movable to communicate the wash ports with the interior of the second cylindrical housing, whereby, upon retrieval of the remedial tubing to the top of the well the means for closing the wash ports may be manipulated to open the wash ports and wash fluid may be introduced into the apparatus and ejected only through the wash ports to drive particulate matter impacted exterior of the remedial tubing and frontal of the apparatus away from said apparatus.

DESCRIPTION OF THE PREFERRED EMBODIMENTS

Figure 1:
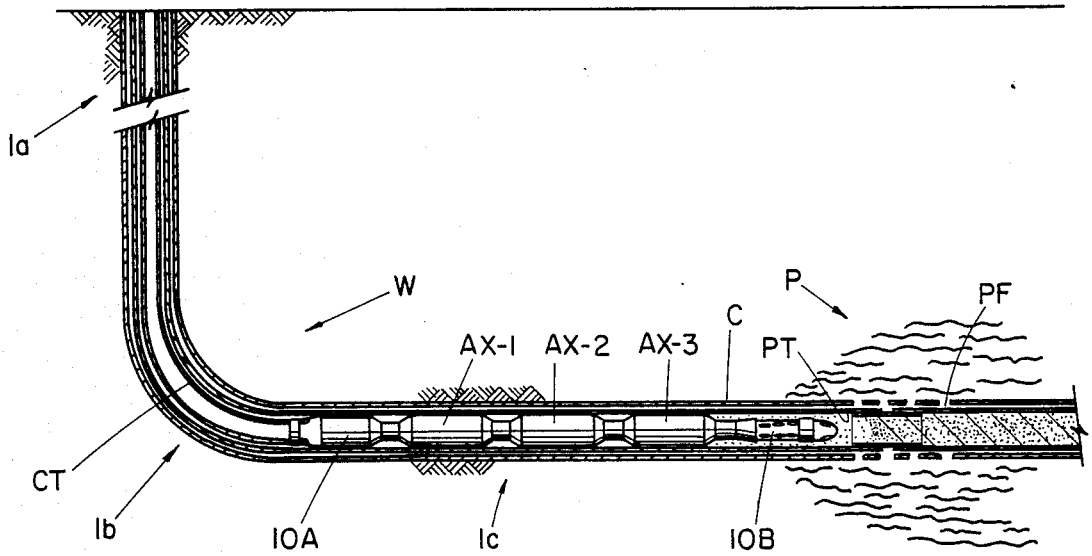
FIG. 1 is a schematic sectional illustration of a horizontal completion of a subterranean well with a device of the present invention inserted through production tubing and carried on remedial tubing.
Figure 4:
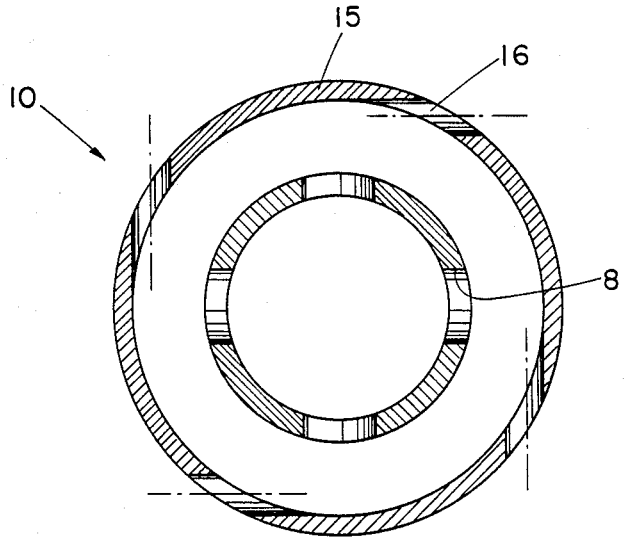
FIG. 4 is a cross-sectional view looking downwardly along line 4—4 of FIG. 2.

Now with reference to FIG. 1, there is shown a deviated wellbore W of the type for which this invention is useful Such wellbore W comprises a vertical entry section 1*a* communicating through a relatively short radius curvature portion 1*b* with a non-vertical or horizontal portion 1*c* communicating with the production formation P with perforations PF disposed through a casing conduit C carried exteriorly of production tubing PT. In most instances, the production formation P extends for a substantial horizontal extent and the generally linear wellbore portion 1*c* traverses a substantial horizontal extent of the production formation, at least up to a distance of 1000 to 2000 feet or more. The radius portion 1*b* of the wellbore W has a curvature of at least 10° per 100 feet of length and preferably a curvature lying in the range of 10° to 30° per 100 feet of length.

A casing C has been previously inserted in the wellbore W and perforated as shown at PF, within the linear nonvertical or horizontal portion 1*c* traversing the production formation P. Particulate matter G is shown being compactedly deposited within the interior of the casing C around the production tubing PT and ahead of the apparatus 10*b* which is carried within the wellbore W on remedial tubing CT inserted through the uppermost end thereof.

Figure 2:
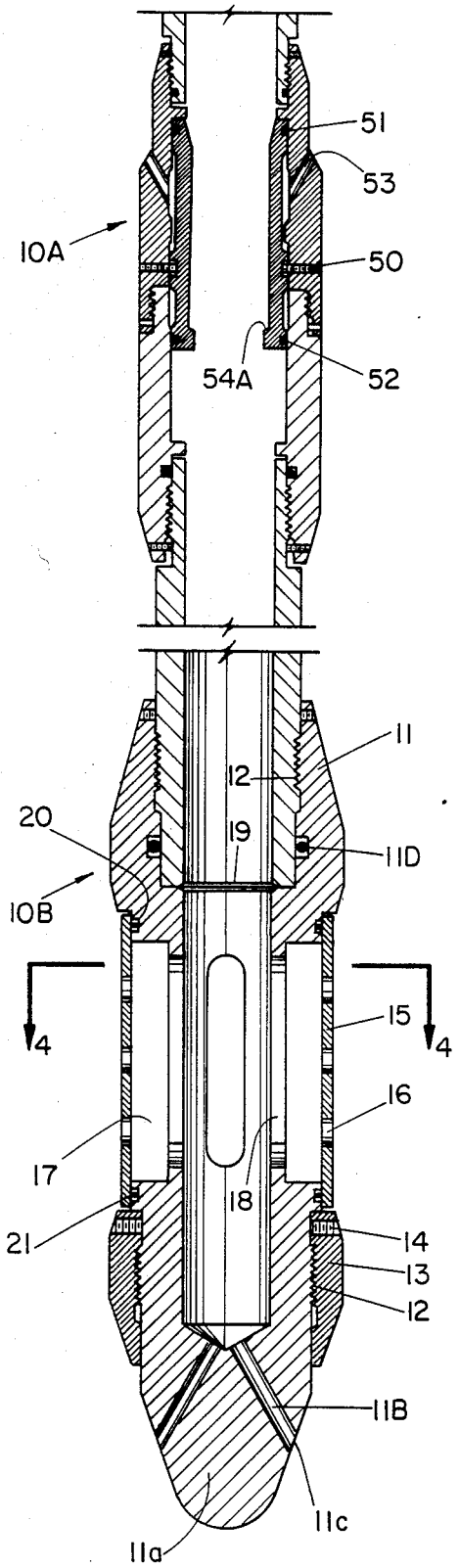
FIG. 2 is a longitudinal sectional drawing showing the apparatus with pressurized fluid flow therethrough for turbulizing action and rotary motion of said sleeve means to wash said particulate matter.
Figure 3:
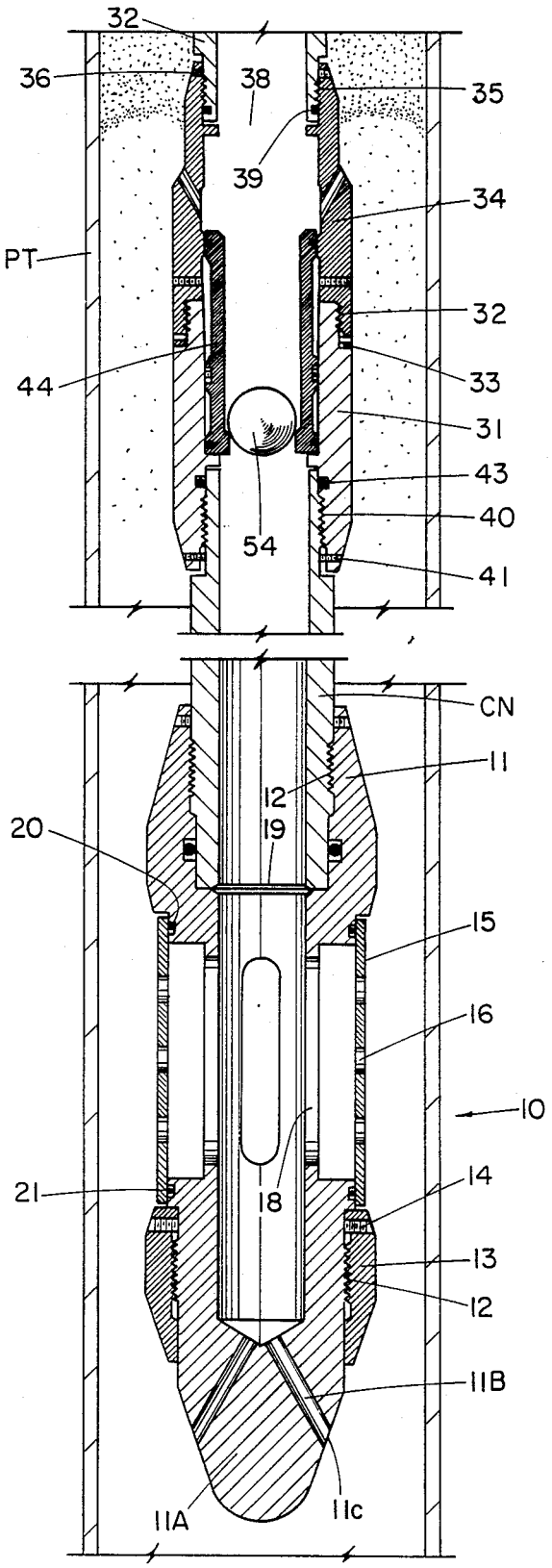
FIG. 3 is a longitudinal sectional view of the apparatus of the present invention similar to that shown in FIG. 2 with the apparatus being shifted to communicate the wash ports with the interior of the apparatus and fluid being flowed only through such wash ports to eject same radially and frontally toward the remedial tubing to wash the particulate matter away from the remedial tubing as it is retrieved to the top of the well.

Now referring to FIGS. 2 and 3, there is shown apparatuses 10*a* and 10*b*. The apparatus 10*b* has a generally cylindrical housing 11 with means, i.e. threads 12, at one end of the housing 11 for carryable securement relative to one end of a connector CN. Of course, it will be appreciated that the apparatus 10*b* may be directly secured to one end of the remedial tubing, but, typically, such tubing CT will carry within the well additional apparatuses, AX-1, AX-2 and AX-3 (FIG. 1), such as shifting devices for sliding sleeves, valve members, and the like, with the apparatus 10*b* being indirectly affixed to the end of the continuous remedial tubing CT at the lowermost end of such tubing CT and said auxiliary devices. A circumferentially extending elastomeric O-ring seal member 11*d* is carried within the housing 11 to prevent fluid communication between the housing 11 and a connector CN extending from the apparatus 10*b* by means of the housing 11 to either the remedial tubing CT, or to an auxiliary apparatus carried ahead of said apparatus 10*b*.

Exterior of the apparatus 10*b* and carried adjacent its lowermost end is a donut-like sleeve element 13 secured exteriorly around the housing 11 by means of threads 12 and set screw 14, the outer diameter of the sleeve 13 being greater than the outer diameter of a tubulating sleeve means 15 carried circumferentially around the exterior of the housing 11 thereabove.

It should also be noted that the uppermost end of the housing 11 above the turbulating sleeve means 15 has a outer diameter in excess of that of the turbulating sleeve means 15 to afford protection thereof and to assure that rotary action, described below, of the turbulating sleeve means 15 is not interfered with by contact and resistance action of the apparatus 10*b* within the interior of the production tubing PT.

The turbulating sleeve means 15 is cylindrical in nature and has thereon a series of radially extending fluid compression ports 16 communicating between the exterior of the apparatus 10*b* and a fluid expansion chamber 17 defined between the exterior of the housing 11 and the interior of the turbulating sleeve means 15. The fluid expansion chamber 17 communicates with the hollow interior 19 of the apparatus 10*b* by means of circumferentially emplaced fluid passageways 18.

Elastomeric seal elements 20, 21 are placed on the housing 11 to communicate with the uppermost and lowermost ends, respectively, of the turbulating sleeve means 15. Such members 20, 21 may be formed of a hard elastomer, or, alternatively, may be made of nitril, or other metallic-like substance to combine the features of fluid flow prevention and bearing surfaces.

The housing 11 has defined at its outboard-most end a frontal conically shaped nose member 11*a* having fluid ejection passageways 11*b* extending therein and being in communication with the interior 19 of the apparatus 10*b*, the passageways 11*b* having port means 11*c* at the outboard-most end of the fluid passageways 11*b* for ejection of washing fluid through the apparatus 10*b* by means of the hollow interior 19, thence through the passageway 11*b* and out the ports 11*c*.

The ports 11*c* are angularly positioned within the nose member 11*a* such that they eject washing fluid thereout in a flow form along the top and bottom of the production tubing PT within the generally linear end section of the subterranean well W. In such fashion, the fluid ejection passageways 11*b* in concert with the ports 11*c* are angularly offset one from another to direct the action of the washing fluid frontal and above and frontal and below the apparatus 10*b* within the generally linear end portion of the well W.

The ports 16 through the sleeve 15 are angularly offset 90° relative to the passageways 18 within the housing 11, but such degree of angular offset may be somewhat varied depending upon the desired turbulating effect of the injection fluid through the remedial tubing CT.

The invention also contemplates an apparatus 10*a* configuration for providing washing of contaminant which has been collected around the remedial tubing CT during the completion operation, whatever that may be. The apparatus 10*a* includes a longitudinally extending cylindrical housing member 31 which is secured by means of threads 32 and set screw 33 to an upper housing member 34 which, in turn, is secured by means of threads 35 and set screw 36 to a connecting member 37. The connecting member 37 may secure the apparatus 10*a* directly to the remedial tubing CT, or to auxiliary apparatuses AX-1, AX-2, or AX-3, described above, which may thus permit the apparatus 10*a* to be indirectly secured to the remedial tubing CT but carried nevertheless thereby.

The apparatus 10*a* has a cylindrical interior 38 for transmission of fluid carried within the remedial tubing CT therethrough. A circumferentially extending elastomeric O-ring seal element 39 is housed within the upper housing member 34 to prevent fluid communication between the upper housing member 34 and the connection tubular member 37.

The housing 31 is secured by means of threads 40 and a set screw 41 therebelow to a lower cylindrical member CN which communicates with other tools therebelow, as shown in the drawings. An elastomeric O-ring seal 43 similar to that of seal means 39 is positioned on the housing 31 to prevent fluid communication between the housing 31 and the tubular member 42 at the lowermost end of the apparatus 10*a*.

Interior of the apparatus 10*a* and within the housing member 31 is a cylindrical member 44. The cylinder 44 is held in the initial closed position (FIG. 2) by mean of a shear pin 50. The sleeve 44 bridges the members 34, 31 such that seals 51 and 52 thereon prevent fluid communication between the interior 38 of the apparatus 10*b* and a series of circumferentially extending radial wash ports 53 which are angularly configured such that when the sleeve 44 is shearably disengaged and shifted to its downward-most position within the interior of the apparatus 10*b*, the interior 38 of the apparatus 10*a* is in communication with the ports 53 and fluid may be introduced through the remedial tubing CT through the apparatus 10*a* and the interior 38 thereof and out only the wash ports 53 such that such fluid is ejected exteriorly of said apparatus 10*a* toward said remedial tubing CT to wash contaminant within an annular area between the production tubing PT and the remedial tubing CT away from the apparatus 10*a* so that such remedial tubing CT and apparatus 10*a* are not lodged within such compacted material whereby retrieval of the remedial tubing CT to the top of the well is interfered with as a result of such compaction.

A ball 54 (FIG. 3) is implaced upon a profile seat 54*a* at the lowermost end of the sleeve 44 when it is desired to shift the sleeve 44 to position to communicate the wash ports 53 with the interior 38 of the apparatus 10*a*.

The positioning of such ball 54 upon its seat 54*a* not only opens the wash ports 53 but also closes off the lower end of the sleeve 44, whereby fluid introduced through the remedial tubing CT and within the passageway 38 is prevented from passing lowerly through the wash passageways within the apparatus 10*b*.

OPERATION

It will be assumed that the well W has been fractured or, alternatively, drilled through a horizontal section of production P which produces sand with the production fluids, and such particulate matter from such fracturing operation, or as a result of perforations being placed through the casing C, results in compacted particulate material being deposited particularly around the bottom of the interior of the casing C and production tubing PT within the horizontal section of the well W. It is desired to break such compacted material up and suspend same into a washing fluid, or other treatment fluid, to remove same from the well.

Accordingly, the apparatuses 10*a* and 10*b* as shown in FIG. 2 are inserted either directly on the lowermost end of the remedial continuous tubing RT, or, alternatively, are implaced for carriage into the well on the remedial tubing CT along with other apparatuses, such as AX-1, AX-2 and AX-3, as discussed earlier. The tools are affixed, as described, and inserted into the well and positioned just ahead of the compacted particulate matter within the horizontal section of the subterranean well. The pressure within fluid introduced through the remedial tubing RT is increased. If such fluid has not been introduced into the remedial tubing previously, it is now transmitted to pass through the interior 19 of the apparatus 10*a* through the remedial tubing CT at a pressure in excess of a pre-determinable pressure.

As such fluid pressure and flow increases, such fluid passes through the passageways 18 and into the expansion chamber 17. Fluid flow resistance then is effected by the reduced diameter of the ports 16 within the sleeve 15 such that such ports 16 cause such fluid to be compressed and such compression energy is transmitted into rotary turbulizing action of the sleeve 15 relative to the housing 11. As the sleeve 15 rotates at a considerably high rpm rate, such as 1000 rpm, or greater, such fluid will come into contact with a compacted particulate matter PM within the interior of the well W horizontal section and break away and disperse same into suspension within the fluid exterior of the apparatus 11. Now, such particulate matter may be circulated along with the fluid passing exteriorly of the apparatus 10*b* and within the interior of the production tubing 10*b*, as such fluid is continuously pumped to the top of the well in the annular area defined as the exterior of the remedial tubing CT and the interior of the production PT. Alternatively, a cleaning fluid may be introduced downwardly through the production tubing PT casing C annulus for passage through the interior of the production tubing PT adjacent the horizontal section of the subterranean well W for carriage to the top of the well.

Upon completion of the remedial operation, as described, the apparatus 10*a* is activated to avoid the remedial tubing CT from being embedded within compacted particulate matter within the annular area between the production tubing PT and the remedial tubing CT. When it is desired to retrieve the apparatuses 10*a* and 10*b* t the top of the well with remedial tubing CT, the ball 54 is gravitated or pumped through the remedial tubing CT and through the passageway 38 of the apparatus 30 until it becomes sealingly engaged upon the seat 54*a* on the cylinder 44. Now, the passage through the sleeve 44 is blocked, and the shear pin 50 has become shearingly disengaged to permit increase in pressure fluid to shift the sleeve 44 downwardly whereby the wash ports 53 are fluidly communicated with the interior 38 of the apparatus 10*a* and fluid within the apparatus 10*a* which is pumped through the remedial tubing CT may be now introduced through the passageway 38 and may be radially ejected toward the remedial tubing CT outwardly of the apparatus 10*a* through the wash ports 53, such directed fluid flow urging particulate matter which has been embedded against the apparatus 30 while the remedial tubing CT is positioned within the well W during the completion operation of the generally linear end portion of the well W to be accomplished. Now, as fluid is continued to be ejected from the apparatus 10*a* through the wash ports 53, the compacted particulate matter will be urged into fluid suspension and into a non-compacted mode, whereby the remedial tubing CT may be retrieved from position during the completion operation, described above, for retrieval to the top of the well W.

It will be appreciated that the apparatus 10*a* may be used independent of the apparatus 10*b*, but it is preferred that it be used in combination with the apparatus 10*b* such that the composite apparatus will provide a washing turbulizing action during entry of the apparatuses into the horizontal section of the deviated well W and, additionally, a washing action may be effected to direct washing fluid frontally toward the remedial tubing as such remedial tubing CT is retrieved to the top of the well W after completion of the operation in the horizontal section of the well W.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for securement onto one end of a continuous length of remedial tubing introduceable into a subterranean well and concentrically insertable through production tubing previously positioned within said well, said well having a deviated configuration including an entry portion communicating with a curved portion extending downwardly in the well from said entry portion, and a generally linear end portion traversable with a production formation, said apparatus comprising:

(1) first cylindrical housing;

(2) means at one end of said housing for carryable securement relative to said one end of said remedial tubing;

(3) a fluid expansion chamber exterior of said housing;

(4) fluid passageways communicating between the interior of said first cylindrical housing and said expansion chamber;

(5) turbulating sleeve means carried exteriorly around said housing and immediate said expansion chamber and freely rotatable relative to said housing;

(6) a series of fluid compression ports radially disposed through said sleeve means, whereby fluid flow from the top of said well through said remedial tubing in excess of a pre-determinable pressure will be transmitted through said housing, said passageways, and into said compression chamber and said fluid may be thereafter injected through said fluid compression ports to actuate rotary motion of said sleeve and turbulize said fluid for washing action within said linear end portion of said well;

(7) a second cylindrical housing positioned between said first cylindrical housing and said remedial tubing;

(8) normally closed wash ports circumferentially extending radially around said second cylindrical housing and angularly directed rearwardly and relative to said apparatus and toward said remedial tubing; and (9) means for closing said wash ports and selectively movable to communicate said wash ports with the interior of said second cylindrical housing, whereby, upon retrieval of said remedial tubing to the top of the well, said means for closing said wash ports may be manipulated to open said wash ports and wash fluid may be introduced into said apparatus and ejected only through said wash ports to drive particulate matter impacted exterior of said remedial tubing and said apparatus away from said apparatus.

2. The apparatus of claim 1 wherein said means for closing said wash tool comprises a cylindrical sleeve shearably secured to said second cylindrical housing, and a ball element implaceable thereon, whereby upon implacement of said ball element upon said sleeve, said sleeve may be sheared relative to said housing and said wash ports may be opened relative to the interior of said second cylindrical housing.

3. The apparatus of claim 1 further comprising:

a frontal conically shaped nose member on said first housing;

fluid ejection passageways through said conically shaped nose member communicating with the interior of said first housing;

port means on said nose and extending to the outboard end of said passageways whereby pressurized fluid transmitted through said remedial tubing and said first housing will be ejected through said nose to wash particulate matter within said linear end portion away from and ahead of said apparatus.

4. The apparatus of claim 3:

said fluid ejection passageways being angularly offset one from another to direct the action of said fluid frontal and above and frontal and below said apparatus within said linear end portion.

5. The apparatus of claim 1 wherein said fluid compression ports are angularly offset 90° relative to said fluid passageways.

6. Method of washing contaminant particulate matter within the linear end portion of a subterranean well, said well having a deviated configuration including an entry portion communicating with a curved portion extending downwardly in the well from said entry portion and a generally linear end portion traversable with a production formation, comprising the steps (1) securing onto one end of a continuous length of remedial tubing introduceable into said subterranean well concentrically through production tubing previously positioned within said well, an apparatus having:

(a) first cylindrical housing;

(b) means at one end of said housing for carryable securement relative to said one end of said remedial tubing;

(c) a fluid expansion chamber exterior of said housing;

(d) fluid passageways communicating between the interior of said first cylindrical housing and said expansion chamber;

(e) turbulating sleeve means carried exteriorly around said housing and immediate said expansion chamber and freely rotatable relative to said housing;

(f) a series of fluid compression ports radially disposed through said sleeve means, whereby fluid flow from the top of said well through said remedial tubing in excess of a pre-determinable pressure will be transmitted through said housing, said passageways, and into said compression chamber and said fluid may be thereafter injected through said fluid compression ports to actuate rotary motion of said sleeve and turbulize said fluid for washing action within said linear end portion of said well;

(g) a second cylindrical housing positioned between said first cylindrical housing and said remedial tubing;

(h) normally closed wash ports circumferentially extending radially around said second cylindrical housing and angularly directed rearwardly relative to said apparatus and toward said remedial tubing; and (i) means for closing said wash ports and selectively movable to communicate said wash ports with the interior of said second cylindrical housing, whereby, upon retrieval of said remedial tubing to the top of the well, said means for closing said wash ports may be manipulated to open said wash ports and wash fluid may be introduced into said apparatus and ejected only through said wash ports to drive particulate matter impacted exterior of said remedial tubing and said apparatus away from said apparatus.

(2) inserting said continuous remedial tubing with said apparatus secured thereon into said well to position said apparatus immediate the generally linear end portion of said well;

(3) introducing a washing fluid through said remedial tubing and said apparatus in excess of a predeterminable pressure;

(4) transmitting said pressured washing fluid through said expansion chamber and said fluid compression ports to actuate said sleeve means into rotary motion relative to said housing and turbulize said fluid to wash said contaminant particulate matter away from said apparatus to thereby form a suspension of said particulate matter within fluid exterior of said apparatus and said tubing for subsequent removal to the top of the well;

(5) moving said means for closing said wash ports to communicate said wash ports with the interior of said second cylindrical housing; and (6) introducing fluid through said remedial tubing and said apparatus as said remedial tubing is retrieved through said production tubing to the top of the well whereby during said retrieval of said remedial tubing to the top of the well introducing wash fluid into said apparatus and ejecting said wash fluid only through said wash ports to drive particulate matter impacted exterior of said remedial tubing and said apparatus away from said apparatus said apparatus is retrieved to the top of the well.

7. Method for washing particulate matter impacted exterior of remedial tubing away from said remedial tubing as said apparatus is retrieved to the top of a subterranean well, said remedial tubing being previously introduced into said subterranean well and concentrically inserted through production tubing positioned within said well, comprising the steps of:

(1) securing to said remedial tubing at the top of said well an apparatus comprising:

(a) a cylindrical housing;

(b) normally closed wash ports circumferentially extending radially around said cylindrical housing and angularly directed toward said remedial tubing; and (c) means for closing said wash ports and selectively movable to communicate said wash ports with the interior of the cylindrical housing, whereby, upon retrieval of said remedial tubing to the top of the well, said means for closing said wash ports may be manipulated to open said wash ports and wash fluid may be introduced into said apparatus and ejected only through said wash ports to drive particulate matter impacted exterior of said remedial tubing and said apparatus away from said apparatus as said apparatus is retrieved to the top of the well;

(2) introducing said remedial tubing and said apparatus into the well;

(3) actuating said means for closing said wash ports to communicate said wash ports with the interior of the cylindrical housing; and (4) introducing wash fluid through said opened wash ports while said remedial tubing is retrieved through said production tubing to the top of the well whereby fluid may pass through said wash ports in a generally planar configuration directed away from said apparatus and toward said remedial tubing to wash particulate matter impacted exterior of said remedial tubing and said apparatus away from said remedial tubing and said apparatus.

* * * * *